US005844583A

United States Patent [19]

Onishi et al.

[11] Patent Number: 5,844,583

[45] Date of Patent: Dec. 1, 1998

[54] INK JET RECORDING METHOD AND APPARATUS PROVIDING A PLURALITY OF IMAGE RESOLUTIONS WITH THE SAME AMOUNT OF INK PER DOT

[75] Inventors: Hiroyuki Onishi; Junichi Iida; Masaaki Itano; Akio Owatari; Hiroaki Tojo, all of Suwa, Japan

[73] Assignee: Seiko Epson Corporation, Tokyo, Japan

[21] Appl. No.: 500,632

[22] Filed: Jul. 11, 1995

[30] Foreign Application Priority Data

Jul. 14, 1994 [JP] Japan ..... 6-162376

[51] Int. Cl.[6] ..... B41J 29/38; B41J 2/145; B41J 2/15

[52] U.S. Cl. ..... 347/16; 347/41

[58] Field of Search ..... 347/14, 16, 19, 347/105, 100, 41; 106/31.13

[56] References Cited

U.S. PATENT DOCUMENTS 4,198,642 4/1980 Gamblin ..... 347/41
4,631,548 12/1986 Milbrandt ..... 347/41

FOREIGN PATENT DOCUMENTS 0076948 of 0000 European Pat. Off. .
0378387 of 0000 European Pat. Off. .
0570167 of 0000 European Pat. Off. .

OTHER PUBLICATIONS

Asai Akira, "Impact of an ink drop on paper" Journal of Imaging Science and Technology, vol. 37, No. 2 (Mar./Apr. 1993) pp. 205–207.

*Primary Examiner*—N. Le
*Assistant Examiner*—L. Anderson
*Attorney, Agent, or Firm*—Ladas & Parry

[57] ABSTRACT

An ink jet recording method which can simply realize a plurality of resolutions in a single printer without varying the amount of ink per droplet is disclosed. An ink jet recording method comprises the steps of: selecting a recording medium; changing an image resolution depending on the selected recording medium; and ejecting ink droplets onto the recording medium to form ink dots thereon, wherein the amount of ink of the droplet is constant when the resolution is changed, and wherein the image resolution is changed so that ink penetrability or ink repellency of the recording medium makes the diameters of the ink dots on the recording medium fall in the range of from 100 to 160% of diagonal dot pitch of the resolution.

6 Claims, 3 Drawing Sheets

INK JET RECORDING METHOD AND APPARATUS PROVIDING A PLURALITY OF IMAGE RESOLUTIONS WITH THE SAME AMOUNT OF INK PER DOT

BACKGROUND OF THE INVENTION

1. Field of the Invention

The present invention relates to an ink jet recording method, and more particularly to an ink jet recording method which can realize printing with a plurality of image resolutions without varying the amount of ink per dot.

2. Background Art

In order to enhance an image resolution in a printer, in general, it is necessary to narrow the pitch of dots and, at the same time, to reduce the size of dots to match the pitch. For an ink jet printer wherein very small ink droplets are ejected onto a recording medium to form dots thereon, the reduced dot size is realized by reducing the nozzle diameter of a recording head, or by reducing the amount of ink ejected.

In a printer which realizes a predetermined single resolution alone, the resolution can be achieved by setting the nozzle diameter or the amount of ink ejected at an optimal value.

However, when two or more image resolutions are contemplated in a single printer, the situation becomes complicated. Specifically, a very complicated operation with high accuracy will be needed to mechanically vary the nozzle diameter or the amount of ink ejected with the resolutions. Furthermore, a recording head which has nozzles having different diameters suitable for respective resolutions will be complicated in its mechanism.

For this reason, a method which can simply realize a plurality of resolutions in a single printer has been desired in the art.

SUMMARY OF THE INVENTION

We have now found that a combination of certain ink compositions and certain recording media enables printing with two or more resolution without varying the amount of ink per droplet.

Accordingly, an object of the present invention is to provide an ink jet recording method which can simply realize a plurality of image resolutions in a single printer.

According to the first aspect of the present invention, there is provided an ink jet recording method which enables printing with two or more resolutions on two or more different recording media, comprising the steps of:

selecting a recording medium;

changing an image resolution depending on the selected recording medium; and ejecting ink droplets onto the recording medium to form ink dots thereon, wherein the amount of ink of the droplet is constant when the resolution is changed, and wherein the image resolution is changed so that ink penetrability or ink repellency of the recording medium makes the diameters of the ink dots on the recording medium fall in the range of from 100 to 160% of diagonal dot pitch of the resolution.

According to the first aspect of the present invention, there also provides an ink jet recording device which can carried out the ink jet recording method according to the first aspect of the present invention, comprising:

means for selecting a recording medium;

a recording head for ejecting droplets of ink in a constant amount to form ink dots on the selected recording medium; and means for changing a resolution depending on the selected recording medium;

wherein the image resolution is changed so that ink penetrability or ink repellency of the recording medium makes the diameters of the ink dots on the recording medium fall in the range of from 100 to 160% of diagonal dot pitch in the resolution.

According to the second aspect of the present invention, there is provided an ink jet recording method which enables printing with both high and low resolutions, comprising the steps of:

selecting a recording medium wherein the recording medium is selected from the group consisting of a sized recording paper (the first medium) and a medium which has on its surface a layer having high ink repellency (the second medium); and ejecting droplets of an ink composition in a constant amount per droplet in the range of from 5 to 65 ng/dot onto the selected recording medium to form an image thereon, when the recording medium is the first medium, with low resolution, and, when the recording medium is the second medium, with high resolution, wherein the ink composition has a contact angle with the sized recording paper of 0° as measured one second after the initiation of contact of the ink composition with the sized recording paper, and a surface tension of 20 to 35 mN/m at room temperature.

According to the first aspect of the present invention, there also provides an ink jet recording device which can carry out the ink jet recording method according to the first aspect of the present invention, comprising:

means for selecting a recording medium wherein the recording medium is selected from the group consisting of a sized recording paper (the first medium) and a medium which has on its surface a layer having high ink repellency (the second medium);

a recording head for ejecting droplets of an ink composition in a constant amount per droplet in the range of from 5 to 65 ng/dot; and means for selecting a resolution depending on the selected recording medium used;

wherein the ink composition has a contact angle with a sized recording paper of 0° as measured one second after the initiation of contact of the ink composition with the sized recording paper, and a surface tension of 20 to 35 mN/m at room temperature, and wherein the first medium is used for low-resolution printing and the second medium is used for high-resolution printing.

BRIEF DESCRIPTION OF THE DRAWINGS

FIG. 2 shows the relationship between a dot pitch and a resolution, wherein FIG. 3 shows the formation of an ink dot on a recording medium, wherein

DETAILED DESCRIPTION OF THE INVENTION

The ink jet recording method according to the first aspect of the present invention is in common with the conventional ink jet recording method for the aspect that ink droplets are ejected onto a recording medium to form ink dots thereon. In the ink jet recording method according to the present invention, printing can be carried out with two or more image resolutions using ink droplets which are constant in the amount of ink per droplet when the resolution is changed. Further, in the present invention, the recording medium or the resolution is selected or changed based on whether or not the diameter of the ink dot is 100 to 160% of the dot pitch in the diagonal direction of dots in the resolution. The recording medium selected has ink penetrability or ink repellency. In a resolution, the recording medium is selected taking the ink penetrability or ink repellency into consideration. Specifically, the recording medium is selected whereby the diameters of dots formed by ink droplets on the recording medium is in the range of from 100 to 160%, preferably 100 to 140%, still preferably 110 to 120%, of the diagonal dot pitch of the resolution. This will be explained more detail as follows. In the case of printing with low resolution, a recording medium having high ink penetrability or low ink repellency is selected to make the ink dot spreading large, resulting in the formation of an ink dot having a large diameter. On the other hand, in the case of printing with high resolution, a recording medium having low ink penetrability or high ink repellency is selected to suppress the ink dot spreading, resulting in the formation of an ink dot having a small diameter. Accordingly, in the present invention, the recording medium or the resolution is selected or changed based on whether or not the diameter of the ink dot is 100 to 160% of the dot pitch in the diagonal direction of dots of the resolution.

Figure 1:
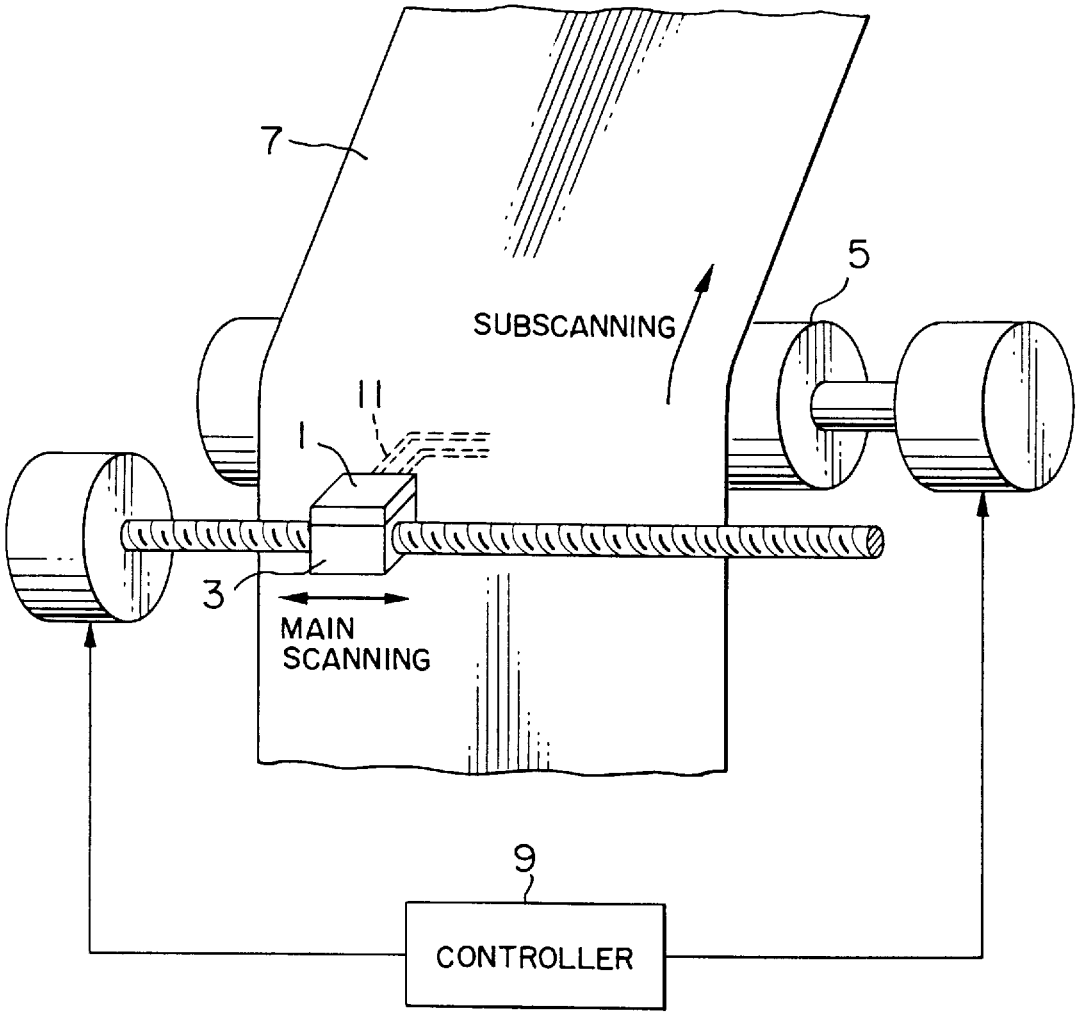
FIG. 1 shows the essential construction of the ink jet recording device according to the present invention.

A device for carrying out the ink jet recording method according to the first aspect of the present invention will now be described with reference to the accompanying drawings. FIG. 1 is a preferred embodiment of the device. A printing head 1 has an ink nozzle (not shown), and ink droplets 11 are ejected through the ink nozzle onto the surface of a recording medium 7 on a platen 5 while moving the ink head 1 in the axial direction of the platen 5 (main scanning direction) by means of a carriage 3. Each time the main scanning is completed, the platen 5 is rotated by a predetermined degree to move the recording medium 7 in the subscanning direction. The repeated movement in the main scanning direction and the subscanning direction forms a two-dimensional dot pattern on the recording medium 7.

The pitch of ink dots formed on the recording medium 7 is determined by the travel speed of the recording head 1, the timing of ejection of ink, and the degree of rotation of the platen 5 per time. These parameters are controlled by a controller 9. The controller 9 conducts control so as to realize a dot pitch suitable for the selected resolution. More specifically, for example, when the low resolution is 360 dpi (dot/inch) and the high resolution is 720 dpi, the dot pitch in each of the main scanning direction and the subscanning direction is controlled at 1/360 inch (about 70 $\mu$m) for the low resolution 360 dpi and 1/720 inch (about 35 $\mu$m) for the high resolution 720 dpi. The changing of the dot pitch in the main scanning direction and the subscanning direction may be carried out by known techniques, for example, those described in Japanese Patent Laid-Open No. 7374/1983 and U.S. Pat. No. 4,198,642.

According to the recording device of the present invention, the dot pitch is changed according to the resolution. In this case, the amount of ink of the droplet ejected from the head 1 remains unchanged independently of the resolution. That is, the head 1 ejects the ink in a constant amount in any resolution.

Figure 2A:
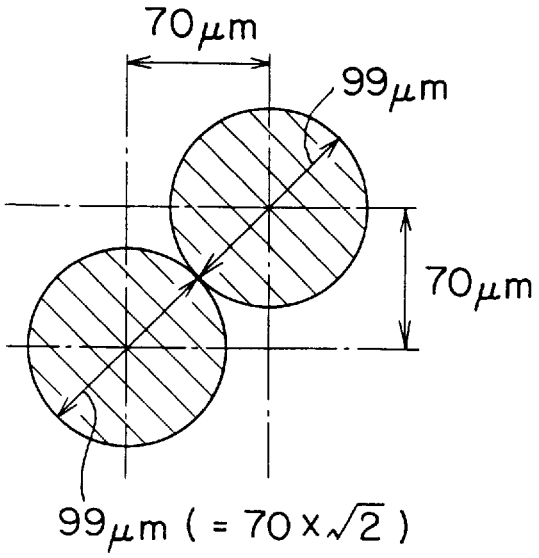
FIGS. 2A and 2B are for 360 dpi and 720 dpi, respectively.
Figure 2B:
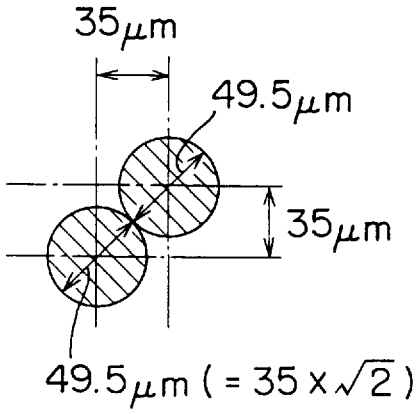

In the present invention, although the amount of ink of the ink droplet ejected onto the recording medium is always kept constant, the diameter of the ink dot formed on the recording medium 7 is varied depending upon the resolution. This will now be described with reference to FIG. 2. FIG. 2A shows the relationship between the resolution 360 dpi and the dot pitch. As shown in the drawing, for this resolution, the dot pitch in each of the main scanning direction and the subscanning direction is about 70 $\mu$m. Therefore, as shown in the drawing, when dots associated with each other in the diagonal direction are in contact with each other (i.e., without leaving any space), the dot diameter is about 99 $\mu$m. This is an ideal dot diameter. In view of the deviation in dot pitch, the dot diameter is preferably larger than the ideal one to prevent any blank space between the dots. Specifically, the dot diameter is preferably in the range of from 100 to 160% of the ideal dot diameter, i.e., in the range of from about 100 $\mu$m to 160 $\mu$m from the viewpoint of realizing a good image. This is true of the case where the resolution is 720 dpi as shown in FIG. 2B. Specifically, in FIG. 2B, the dot pitch in each of the main scanning direction and the subscanning direction is about 35 $\mu$m with the dot pitch in the diagonal direction of the dots being about 49.5 $\mu$m. In order to realize a good image, the dot diameter is preferably in the range of from 100 to 160%, i.e., in the range of from about 50 $\mu$m to 80 $\mu$m. In this embodiment, in order to realize the printing with two or more resolutions, the recording medium or the resolution which is selected or changed based on whether or not the diameter of the ink dot is 100 to 160% of the dot pitch in the diagonal direction of dots of the resolution.

According to the second aspect of the present invention, there provides a method and device for preferably carrying out the recording method according to the first aspect of the present invention. The method and device according to the second aspect of the present invention will now be described.

The sized recording paper used in the method according to the second aspect of the present invention (a "first recording medium") refers to a recording paper generally called "plain paper" which has been subjected to treatment for imparting resistance to ink or water penetration to the paper.

The recording medium having on its surface a layer having high ink repellency used in the second aspect of the present invention (a "second recording medium") refers to a recording medium having on its surface a layer having low affinity for the ink, i.e., a layer having low wettability by the ink. Examples of the second recording medium include recording media such as paper having on its surface a layer, having high ink repellency, containing a water-soluble silicone compound and/or a water-soluble fluorocompound. These substances having low affinity for the ink, such as water-soluble silicone compounds and water-soluble fluorocompounds, may be supported onto the surface of a recording medium, such as paper, with the aid of a binder. If necessary, the layer may contain a white pigment based on silica.

Water-soluble silicone compounds include random, block, or graft copolymers of polyalkyl or polyallylsiloxane (for example, dimethylsiloxane or phenylsiloxane) with higher alcohols (for example, ethylene glycol, trimethylolpropane, pentaerythritol or sorbitol), these random, block, or graft copolymers being soluble in water. Further, a water-soluble copolymer of a siloxane compound with hydroxymethacrylic acid is also a preferred example of the water-soluble silicone compound. The silicone compound may be in the form of a silicone emulsion. Examples of the silicone emulsion include an emulsion prepared by stably dispersing silicone oil (polydimethylsiloxane having a siloxane skeleton (Si—O—Si)) in water and an emulsion prepared by emulsion polymerization of a dimethylsiloxane monomer. Some of the methyl groups in the molecule of the silicone compound may be substituted with an epoxy group, an amino group, a reactive hydrogen, or the like.

Specific examples of the water-soluble fluorocompound include random, block, or graft copolymers of fluoroalkylpolysiloxanes with higher alcohols, which copolymers are soluble in water. The water-soluble fluorine compound may be in the form of a fluororesin emulsion. Examples of the fluororesin emulsion include an emulsion prepared by stably dispersing a fluorosilicone oil in water.

Specific examples of the binder include PVA, oxidized starch, etherified starch, other starch derivatives, gelatin, casein, carboxymethylcellulose, hydroxyethylcellulose, other cellulose derivatives, and polyvinyl pyrrolidone.

Preferred specific examples of the second recording medium include those described in Japanese Patent Laid-Open No. 24908/1991. Commercially available recording media may be used as the second recording medium, and specific examples thereof include Epson Superfine special purpose paper.

The ink composition used in the present invention has a contact angle with a sized recording paper of 0°, as measured one second after the initiation of contact of the ink composition with the sized recording paper, and a surface tension at room temperature of 20 to 35 mN/m, preferably 28 to 33 mN/m. The contact angle and surface tension of the ink composition may be regulated by the components of the ink composition. Specifically, they may be regulated by properly selecting the kind and amount of solvents, surfactants, and dispersants, described below, added to the ink composition.

The ink composition used in the present invention may basically comprise a colorant, an organic solvent, and water.

Preferred examples of the colorant usable in the ink composition include direct dyes, acid dyes, food dyes, basic dyes, reactive dyes, disperse dyes, vat dyes, soluble vat dyes, reactive disperse dyes, and oil dyes. Among others, water-soluble dyes are preferably used from the viewpoint of properties of the recording fluid, and particularly preferred water-soluble dyes include:

C.I. Direct Red 2, 4, 9, 23, 26, 31, 39, 62, 63, 72, 75, 76, 79, 80, 81, 83, 84, 89, 92, 95, 111, 173, 184, 207, 211, 212, 214, 218, 221, 223, 224, 225, 226, 227, 232, 233, 240, 241, 242, 243, and 247;

C.I. Direct Violet 7, 9, 47, 48, 51, 66, 90, 93, 94, 95, 98, 100, and 101;

C.I. Direct Yellow 8, 9, 11, 12, 27, 28, 29, 33, 35, 39, 41, 44, 50, 53, 58, 59, 68, 86, 87, 93, 95, 96, 98, 100, 106, 108, 109, 110, 130, 132, 142, 144, 161, and 163;

C.I. Direct Blue 1, 10, 15, 22, 25, 55, 67, 68, 71, 76, 77, 78, 80, 84, 86, 87, 90, 98, 106, 108, 109, 151, 156, 158, 159, 160, 168, 189, 192, 193, 194, 199, 200, 201, 202, 203, 207, 211, 213, 214, 218, 225, 229, 236, 237, 244, 248, 249, 251, 252, 264, 270, 280, 288, 289, and 291;

C.I. Direct Black 9, 17, 19, 22, 32, 51, 56, 62, 69, 77, 80, 91, 94, 97, 108, 112, 113, 114, 117, 118, 121, 122, 125, 132, 146, 154, 166, 168, 173, and 199;

C.I. Acid Red 35, 42, 52, 57, 62, 80, 82, 111, 114, 118, 119, 127, 128, 131, 143, 151, 154, 158, 249, 254, 257, 261, 263, 266, 289, 299, 301, 305, 336, 337, 361, 396, and 397;

C.I. Acid Violet 5, 34, 43, 47, 48, 90, 103, and 126;

C.I. Acid Yellow 17, 19, 23, 25, 39, 40, 42, 44, 49, 50, 61, 64, 76, 79, 110, 127, 135, 143, 151, 159, 169, 174, 190, 195, 196, 197, 199, 218, 219, 222, and 227;

C.I. Acid Blue 9, 25, 40, 41, 62, 72, 76, 78, 80, 82, 92, 106, 112, 113, 120, 127:1, 129, 138, 143, 175, 181, 205, 207, 220, 221, 230, 232, 247, 258, 260, 264, 271, 277, 278, 279, 280, 288, 290, and 326;

C.I. Acid Black 7, 24, 29, 48, 52:1 and 172;

C.I. Reactive Red 3, 13, 17, 19, 21, 22, 23, 24, 29, 35, 37, 40, 41, 43, 45, 49, and 55;

C.I. Reactive Violet 1, 3, 4, 5, 6, 7, 8, 9, 16, 17, 22, 23, 24, 26, 27, 33, and 34;

C.I. Reactive Yellow 2, 3, 13, 14, 15, 17, 18, 23, 24, 25, 26, 27, 29, 35, 37, 41, and 42;

C.I. Reactive Blue 2, 3, 5, 8, 10, 13, 14, 15, 17, 18, 19, 21, 25, 26, 27, 28, 29, and 38;

C.I. Reactive Black 4, 5, 8, 14, 21, 23, 26, 31, 32, and 34;

C.I. Basic Red 12, 13, 14, 15, 18, 22, 23, 24, 25, 27, 29, 35, 36, 38, 39, 45, and 46;

C.I. Basic Violet 1, 2, 3, 7, 10, 15, 16, 20, 21, 25, 27, 28, 35, 37, 39, 40, and 48;

C.I. Basic Yellow 1, 2, 4, 11, 13, 14, 15, 19, 21, 23, 24, 25, 28, 29, 32, 36, 39, and 40;

C.I. Basic Blue 1, 3, 5, 7, 9, 22, 26, 41, 45, 46, 47, 54, 57, 60, 62, 65, 66, 69, and 71; and C.I. Basic Black 8.

The amount of the dye added is determined depending upon the kind of the dye, the kind of the solvent component, properties required of the ink, and the like. In general, however, it is preferably in the range of from 0.2 to 15% by weight, still preferably 0.5 to 10% by weight, based on the total weight of the ink.

Preferred examples of the organic solvent include high-boiling, low-volatile polyhydric alcohols, such as glycerin, ethylene glycol, diethylene glycol, triethylene glycol, propylene glycol, dipropylene glycol, hexylene glycol, polyethylene glycol, and polypropylene glycol. Further, water-soluble organic solvents, for example, nitrogen-containing organic solvents, such as N-methyl-2-pyrrolidone, 1,3-dimethyl imidazolidinone, monoethanolamine, N,N-dimethylethanolamine, N,N-diethylethanolamine, diethanolamine, N-n-butyldiethanolamine, triisopropanolamine, and triethanolamine may be added in such an amount as will not cause bleeding in the print. Especially, diethylene glycol, glycerin, and the like are preferred. Further, according to a preferred embodiment of the present invention, the ink composition preferably further comprises benzotriazole from the viewpoint of stabilizing the properties of the ink.

Preferred examples of the surfactant and penetrating agent include anionic surfactants, amphoteric surfactants, cationic surfactants, and nonionic surfactants. Examples of the anionic surfactant include alkylsulfocarboxylates, α-olefin sulfonates, polyoxyethylene alkyl ether acetates, N-acyl amino acid and salts thereof, N-acyl methyltaurine salts, alkylsulfate polyoxy alkyl ether sulfates, alkylsulfate polyoxyethylene alkyl ether phosphates, rosin soap, castor oil sulfate, lauryl alcohol sulfate, alkylphenol type phosphates, alkyl type phosphates, alkyl allyl sulfonates, diethylsulfosuccinate, diethylhexylsulfosuccinate, and dioctylsulfosuccinate. Examples of the cationic surfactant include 2-vinylpyridine derivatives and poly-4-vinylpyridine derivatives. Examples of the amphoteric surfactant include lauryl dimethyl aminoacetic acid betaine, 2-alkyl-N-carboxymethyl-N-hydroxyethyl imidazolinium betaine, coconut oil fatty acid amide propyldimethylaminoacetic acid betaine, polyoctyl polyaminoethyl glycine, and imidazoline derivatives. Examples of the nonionic surfactant include ether surfactants, such as polyoxyethylene nonyl phenyl ether, polyoxyethylene octyl phenyl ether, polyoxyethylene dodecyl phenyl ether, polyoxyethylene alkyl allyl ethers, polyoxyethylene oleyl ether, polyoxyethylene lauryl ether, polyoxyethylene alkyl ethers, polyoxyalkylene alkyl ethers; ester surfactants, such as polyoxyethylene oleic acid, polyoxyethylene oleate, polyoxyethylene distearate, sorbitan laurate, sorbitan monostearate, sorbitan monooleate, sorbitan sesquioleate, polyoxyethylene monooleate, and polyoxyethylene stearate; acetylene glycol surfactants, such as 2,4,7,9-tetramethyl-5-decyn-4,7-diol, 3,6-dimethyl-4-octyn-3,6-diol, and 3,5-dimethyl-1-hexyn-3-ol (for example, Surfynol 104, 82, 465, and TG, manufactured by Nissin Chemical Industry Co., Ltd.); fluorosurfactants, such as fluorine-substituted alkyl esters and perfluoroalkyl carboxylates (for example, Ftergent series manufactured by Neos Co., Ltd., Lodyne series manufactured by Ciba-Geigy, Zonyl series manufactured by Du Pont, Monflor series manufactured by ICI, Surfluon series manufactured by Asahi Glass Co., Ltd., Unidyne series manufactured by Daikin Industries, Ltd., and FC Series, manufactured by Sumitomo 3M Ltd.). The use of fluorosurfactants, particularly amphoteric or nonionic surfactants is preferred. The amount of the surfactant added may be suitably determined. For the fluorosurfactants, however, it is preferably about 1 to 10,000 ppm.

In the ink jet recording method according to the second aspect of the present invention, the image resolution for recording on the first recording medium is different from that for recording on the second recording medium. Specifically, the recording on the first recording medium is carried out with low resolution, while the recording on the second recording medium is carried out with high resolution. In this case, for both the recording media, the amount of ink per dot may be identical and in the range of from 5 to 65 ng. According to a preferred embodiment of the present invention, the amount of ink per dot is preferably in the range of 30 to 50 ng. In the method of the present invention, the resolution is varied according to the particular recording media. In the printing, however, the amount of ink per dot is identical. The print obtained in this way is free from bleeding and has a high quality for any resolution.

According to a preferred embodiment of the present invention, when the first recording medium is used, the image resolution is preferably not more than 400 dpi, while when the second recording medium is used, the image resolution is preferably more than 400 dpi. The relationship between the recording medium and the resolution, however, is not limited to this embodiment alone, and it is possible to use a combination of 360 dpi with 720 dpi or a combination of 720 dpi with 1440 dpi.

Figure 3A:
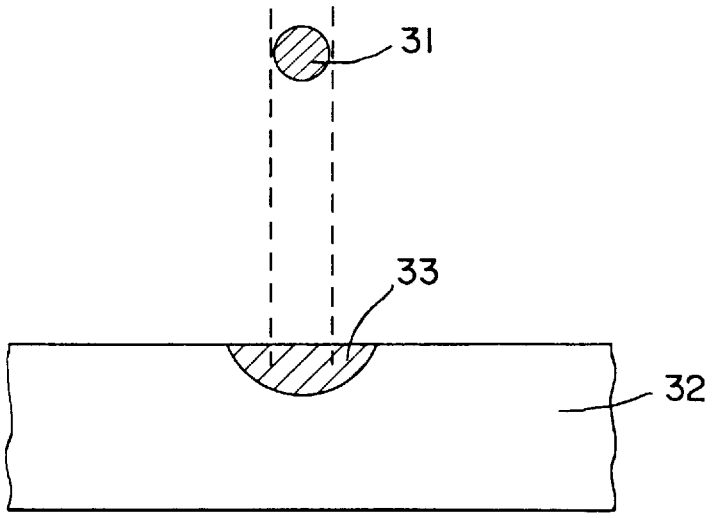
FIG. 3A shows the formation of an ink dot on a sized recording paper and FIG. 3B shows the formation of an ink dot on a recording medium having an ink-repellent layer.
Figure 3B:
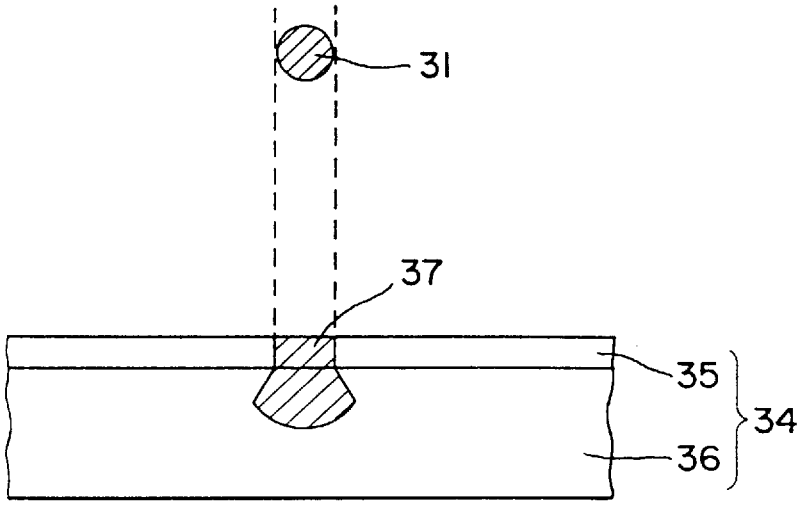

In the recording method according to the second aspect of the present invention, the formation of an ink dot will now be described with reference to FIG. 3. An ink droplet 31 ejected onto a first recording medium 32 forms an ink dot 33 having a slightly larger than an ink droplet 31 upon deposition of the ink droplet onto the first recording medium 32. This is attributable to the fact that the first recording medium has good wettability by the ink composition, i.e., ink penetrability. On the other hand, an ink droplet 31 ejected onto a second recording medium 34 first deposits onto a layer 35 having high ink repellency provided on the second recording medium 34. The ink droplet 31 is absorbed into the recording medium without significant spreading on the recording medium 34 by virtue of high ink repellency of the layer 35 and reaches a substrate 36 such as paper. As described above, according to the method of the present invention, ink dots having different diameters may be formed with ink droplets identical to each other in amount of ink per dot. A combination of this advantage with switching of the resolution enables printing to be carried out with a plurality of resolutions using ink droplets identical to each other in amount of ink per droplet.

The device for carrying out the recording method according to the second aspect of the present invention basically has a construction shown in FIG. 1. This device is constructed so that a recording head 1 can eject droplets of ink in an identical ink amount per droplet in the range of from 5 to 65 ng.

EXAMPLES

The present invention will now be described in more detail with reference to the following examples, though it is not limited to these examples only.

Preparation of Ink Compositions

Ink compositions for black (B), yellow (Y), magenta (M), and cyan (C) described as Examples 1 to 3 and Comparative Examples 1 and 2 shown in the following Tables 1 and 2 were prepared by mixing the components specified in the tables together and heating and stirring the mixture.

TABLE 1

| | Ex. 1 | | | | Ex. 2 | | | | Ex. 3 | | | |
|---|---|---|---|---|---|---|---|---|---|---|---|---|
| Unit [wt %] | B | Y | M | C | B | Y | M | C | B | Y | M | C |
| C.I. Direct Black 154 | 5 | | | | 5 | | | | 4 | | | |
| C.I. Direct Black 9 | | | | | | | | | | | | |
| C.I. Direct Yellow 132 | | 2 | | | | 0.75 | | | | 1.75 | | |
| C.I. Direct Yellow 86 | | | | | | 1 | | | | | | |
| C.I. Acid Red 289 | | | 2 | | | | 1 | | | | 2 | |
| C.I. Acid Red 52 | | | | | | | 1 | | | | | |
| C.I. Direct Blue 199 | | | | 3.5 | | | | 3.5 | | | | 3 |
| C.I. Direct Blue 86 | | | | | | | | | | | | |
| TEG-mBE | 10 | 10 | 10 | 10 | | | | | | | | |
| DEG mBE | | | | | 10 | 10 | 10 | 10 | | | | |
| Surfynol 465 | 0.5 | 0.5 | 0.5 | 0.5 | 0.8 | 0.8 | 0.8 | 0.8 | 3 | 3 | 3 | 3 |
| Diethylene glycol | 8 | 10 | 10 | 15 | 5 | 16 | 17 | 13 | 20 | 25 | 25 | 26 |
| Glycerin | | 8 | 8 | | | | | | | | | |

TABLE 1-continued

| | Ex. 1 | | | | Ex. 2 | | | | Ex. 3 | | | |
|---|---|---|---|---|---|---|---|---|---|---|---|---|
| Unit [wt %] | B | Y | M | C | B | Y | M | C | B | Y | M | C |
| Ftergent | | | | | | | | | 0.02 | 0.02 | 0.02 | 0.02 |
| Proxel XL-2 | 0.3 | 0.3 | 0.3 | 0.3 | 0.3 | 0.3 | 0.3 | 0.3 | 0.3 | 0.3 | 0.3 | 0.3 |
| Benzotriazole | 0.005 | 0.005 | 0.005 | 0.005 | 0.005 | 0.005 | 0.005 | 0.005 | 0.005 | 0.005 | 0.005 | 0.005 |
| Ultrapure water | 76.195 | 69.195 | 68.195 | 70.695 | 78.895 | 71.145 | 69.895 | 72.395 | 72.675 | 69.925 | 69.675 | 67.675 |
| Surface tension [mN/m] | 31.0 | 33.1 | 34.6 | 30.4 | 29.5 | 28.6 | 24.5 | 26.6 | 21.1 | 20.9 | 20.6 | 20.6 |
| Contact angle (°) | 0 | 0 | 0 | 0 | 0 | 0 | 0 | 0 | 0 | 0 | 0 | 0 |

TABLE 2

| | Comp. Ex. 1 | | | | Comp. Ex. 2 | | | |
|---|---|---|---|---|---|---|---|---|
| Unit [wt %] | B | Y | M | C | B | Y | M | C |
| C.I. Direct Black 154 | 5 | | | | | | | |
| C.I. Direct Yellow 132 | | 2 | | | | 0.75 | | |
| C.I. Direct Yellow 86 | | | | | | 1 | | |
| C.I. Acid Red 289 | | | 2 | | | | 1 | |
| C.I. Acid Red 52 | | | | | | | 1 | |
| C.I. Direct Blue 199 | | | | 3.5 | | | | 3.5 |
| Ethanol | | | | | 7 | 7 | 7 | 7 |
| Diethylene glycol | 8 | 18 | 19 | 15 | | | | |
| Glycerin | | | | | 5 | 10 | 10 | 10 |
| Proxel XL-2 | 0.3 | 0.3 | 0.3 | 0.3 | 0.3 | 0.3 | 0.3 | 0.3 |
| Benzotriazole | 0.005 | 0.005 | 0.005 | 0.005 | 0.005 | 0.005 | 0.005 | 0.005 |
| Ultrapure water | 86.695 | 79.695 | 78.695 | 81.195 | 82.675 | 79.945 | 80.695 | 79.195 |
| Surface tension [mN/m] | 56.2 | 58.1 | 54.5 | 56.5 | 46.1 | 49.2 | 46.5 | 96.7 |
| Contact angle (°) | 22 | 26 | 28 | 29 | 13 | 9 | 11 | 11 |

Printing test

Color images were printed with an ink jet printer, MJ-700V2C (manufactured by Seiko Epson Corporation) using a combination of the inks of Examples 1 to 3 and Comparative Examples 1 and 2. The color images were formed in a Japan Standard Association SCID pattern.

The printer was modified so that the amount of ink ejected could be varied. Printing was carried out by ejecting the ink in an amount per dot with resolutions as indicated in Table 3. In the table, recording paper A is Xerox P paper (plain paper) and recording method B is Epson Superfine (special purpose paper).

The resultant prints were evaluated by visual inspection according to the following criteria:

Good image with no bleeding: excellent (◎)

Good image with no significant bleeding: good (○)

Image with somewhat bleeding: somewhat poor (Δ)

Image with severe bleeding: poor (X)

The results were as shown in Table 3.

TABLE 3

| | Amount of ink ejected (ng/dot) | | | | | | | |
|---|---|---|---|---|---|---|---|---|
| | 10 | | 30 | | 60 | | 70 | |
| | Recording paper | | | | | | | |
| | A | B | A | B | A | B | A | B |
| | Resolution (dpi) | | | | | | | |
| | 720 | 1440 | 360 | 720 | 360 | 720 | 360 | 720 |
| Ex. | | | | | | | | |
| 1 | ◎ | ◎ | ◎ | ◎ | ○ | ◎ | Δ | X |
| 2 | ◎ | ◎ | ◎ | ○ | ◎ | ◎ | Δ | X |
| 3 | ◎ | ◎ | ◎ | ◎ | ○ | ◎ | Δ | X |
| Comp. Ex. | | | | | | | | |
| 1 | Δ | Δ | X | X | X | X | X | X |
| 2 | Δ | Δ | X | X | X | X | X | X |

What is claimed is:

1. An ink jet recording method which enables printing, from a print head, with two or more resolutions on two or more different recording media, comprising the steps of:

selecting a recording medium;

selecting an image resolution depending on the selected recording medium;

ejecting ink droplets from the print head onto the recording medium to form ink dots thereon, each droplet producing a respective dot, and causing the amount of ink of the droplets to be constant for the dots of all of the recording media so that the image resolution for the different changes regarding media, said image resolution being selected according to the ink penetrability or ink repellency of the selected recording medium which makes the diameters of the ink dots on the recording medium fall in the range of from 100 to 160% of a diagonal dot pitch of the image resolution.

2. An ink jet recording device which enables printing with two or more image resolutions on two or more different recording media, comprising:

means for selecting a recording medium from said two or more recording media;

a recording head for ejecting droplets of ink in a constant amount, each droplet forming a respective ink dot on the selected recording medium;

means for selecting a resolution of the formed image depending on the selected recording medium;

the image resolution being selected for different recording media based on ink penetrability or ink repellency of the recording media, said recording head producing said droplets of ink in a constant amount on the different media to produce respective diameters of the ink dots on the recording media in the range of from 100 to 160% of a diagonal dot pitch in the image resolution.

3. An ink jet recording method which enables printing, from a print head, with both high and low resolutions, comprising the steps of:

providing a first recording medium which has a surface with a layer of high ink penetrability and a second recording medium which has a surface with a layer having high ink repellency;

selecting one of said first and second recording media for printing an image thereon;

ejecting, from the print head, droplets of an ink composition in a constant amount per droplet in a range of from 5 to 65 ng/dot onto a selected one of said first and second recording media to form an image thereon, and wherein when the recording medium is the first medium, said image is formed with low resolution, and, when the recording medium is the second medium, said image is formed with high resolution, and providing said ink composition with a contact angle with the first recording medium of 0° as measured one second after the initiation of contact of the ink composition with the first recording medium, and a surface tension of 20 to 35 mN/m at room temperature.

4. The ink jet recording method according to claim 3, wherein said image resolution is not more than 400 dpi when printing on the first medium and said image resolution is more than 400 dpi when printing on the second medium.

5. The ink jet recording method according to claim 3, wherein said layer of high ink penetrability on said first recording medium comprises a layer of sizing.

6. An ink jet recording device which enables printing with both high and low resolutions, comprising:

a first recording medium which has a surface with a layer of high ink penetrability and a second recording medium which has a surface with a layer having high ink repellency;

a recording head for ejecting droplets of an ink composition in a constant amount per droplet in a range of from 5 to 65 ng/dot;

means for selecting one of said first and second recording media depending on a selected desired image resolution, wherein the ink composition has a contact angle with said first recording medium of 0° as measured one second after the initiation of contact of the ink composition with the first recording medium, and a surface tension of 20 to 35 mN/m at room temperature, and wherein for said constant amount of ink in said droplets said first recording medium provides an image of low resolution whereas said second recording medium provides an image of high resolution.

* * * * *